US005364031A

United States Patent [19]

Taniguchi et al.

[11] Patent Number: 5,364,031

[45] Date of Patent: Nov. 15, 1994

[54] FOAM DISPENSING NOZZLES AND DISPENSERS EMPLOYING SAID NOZZLES

[75] Inventors: Tatsuya Taniguchi, Nishinomiya, Japan; Dimitris I. Collias, Cincinnati, Ohio

[73] Assignee: The Procter & Gamble Company, Cincinnati, Ohio

[21] Appl. No.: 75,190

[22] Filed: Jun. 10, 1993

[51] Int. Cl.[5] ..... B05B 1/14

[52] U.S. Cl. ..... 239/330; 239/343; 239/590.3; 239/DIG. 23

[58] Field of Search ..... 239/DIG. 23, 590, 590.3, 239/343, 575, 329, 330

[56] References Cited

U.S. PATENT DOCUMENTS

| | | | |
|---|---|---|---|
| 3,446,285 | 5/1969 | Hout | 239/590.3 X |
| 4,350,298 | 9/1982 | Tada | 239/343 X |
| 5,085,371 | 2/1992 | Paige | 239/343 |

FOREIGN PATENT DOCUMENTS

| | | | |
|---|---|---|---|
| 2024049 | 1/1980 | United Kingdom | 239/343 |

*Primary Examiner*—Andres Kashnikow
*Assistant Examiner*—Kevin P. Weldon
*Attorney, Agent, or Firm*—Michael E. Hilton; John M. Howell; Daniel F. Nesbitt

[57] ABSTRACT

Foam dispensing nozzles and manually actuable foam dispensers for producing and dispensing improved foams made from a foamable liquid and gas. The foam dispensing nozzles include a velocity decreasing structure so that the average foam velocity through the foam refining apparatus does not exceed a certain value.

10 Claims, 6 Drawing Sheets

FOAM DISPENSING NOZZLES AND DISPENSERS EMPLOYING SAID NOZZLES

FIELD OF THE INVENTION

This invention relates generally to dispensing nozzles and dispensers employing said nozzles and to an improved method for making and dispensing an improved foam from a foamable liquid.

BACKGROUND OF THE INVENTION

Foam compositions are useful in a number of product categories, including skin and hair care products and cleaning products, such as hand soap, shampoo, body soap, hair mousse, shaving foam and kitchen cleanser. For example, foam compositions can provide improved spreadability and distribution of the ingredients in the hair or on the skin relative to gel, lotion, or cream forms of such compositions, particularly when a low level of the composition is intended to be used. In addition, there has been significant improvement in the efficacy of skin and hair care products, notably through the use of polymers. The use of such polymers can result in a foamable liquid having a higher viscosity, which, as is described below, can effect the quality and the ease of dispensing of the foam made therefrom.

In general, a foam is generated by mixing a foamable liquid and a gas. Dispensers and dispensing nozzles for forming and dispensing a foam from a foamable liquid are well known. In the case of pump foam and squeeze foam dispensers (also called pump foamers and squeeze foamers, respectively), the gas is normally air, while in the case of aerosol dispensers, the gas is liquefied propane gas or other liquid propellant. (Hereinafter the gas will be referred to generally as air unless otherwise specified.) The mixture of foamable liquid and air approaching and entering the foam dispensing nozzle, which houses the foam refining means, can be a simple mixture or can itself be substantially a foam. Although the liquid and air mixture can be partially separated into large bubbles of air and/or streams of liquid, it is preferred that the bubble-containing foam mixture be substantially intermixed and more uniformly sized prior to it passing through the foam refining means and forming a final foam. The uniformity of the size of the bubbles of a foam can be improved by using a foam refining means that has uniform passageway size and orientation.

As described, for example, in U.S. Pat. No. 3,709,437, issued to Wright on Jan. 9, 1973, U.S. Pat. No. 3,937,364, issued to Wright on Feb. 10, 1976, U.S. Pat. No, 4,156,505, issued to Bennett on May 29, 1979, and U.S. Pat. No. 4,880,161, issued to Wright on Nov. 14, 1989, such dispensers and dispensing nozzles form a foam by mixing a foamable liquid and air, and discharging the resulting foam.

Foam dispensing nozzles and dispensers have used a variety of means and methods for containing the liquid and the air, and for bringing the liquid and air together to be mixed into a foam, including aerosol canisters, deformable reservoirs and foam pumps which are squeezed or actuated by the user to express the foamable liquid and air to a mixing chamber. Also known are such dispensing nozzles and dispensers which employ one or more means, such as a meshed screen or porous frit, to further refine the mixture which has been formed once the foamable liquid and air have been combined with one another.

In alternative embodiments, the foaming compositions of the present invention are also contemplated to be deliverable from other types of dispensers having a foam dispensing nozzle described above. Examples of alternative dispensers are conventional squeeze foamer packages which can be fitted with the foam dispensing nozzle of the present invention. Prior art squeeze roamers comprise a deformable container or reservoir for containing the liquid product to be dispensed and a foamer head, nozzle, or other foam producing means. The foamer product is produced from these squeeze foamer devices by squeezing the container with the hand to force the contained liquid product through the foamer head, nozzle, or other foam producing means. However, the conventional foamer heads, nozzles, and other foam producing means of current squeeze foamers are unable to deliver the foamable compositions of the present invention as foams having the highly desirable characteristics described herein.

Squeeze foamers suitable for use herein can be provided by fitting conventional, deformable squeeze foamer containers or reservoirs with the foam dispensing nozzles of the present invention. Conventional, squeeze foamer containers and reservoirs useful for fitting with the foam dispensing nozzles of the present invention are described in the following patents, all of which are hereby incorporated by reference in their entirety: U.S. Pat. No. 3,709,437, to Wright, issued on Jan. 9, 1973; U.S. Pat. No. 3,937,364, to Wright, issued on Feb. 10, 1976; U.S. Pat. No. 4,022,351, to Wright, issued on May 10, 1977; U.S. Pat. No. 4,147,306, to Bennett, issued on Apr. 3, 1979; U.S. Pat. No. 4,184,615, to Wright, issued on Jan. 22, 1980; U.S. Pat. No. 4,598,862, to Rice, issued on Jul. 8, 1986; U.S. Pat. No. 4,615,467, to Grogan et al., issued on Oct. 7, 1986; and French Pat. No. 2,604,622, to Verhulst, published on Apr. 8, 1988.

Pressurized aerosol delivery systems are also well-known in the art and generally comprise a reservoir (usually a metal canister) for containing the composition to be dispensed and the propellant (usually a gas or liquefied gas) for dispensing the composition, a dip tube, and a nozzle. Aerosol delivery systems can be prepared by fitting a canister and dip tube with a nozzle of the present invention and charging the delivery system with the composition to be delivered and a suitable propellant. The level of propellant, based on the total weight of the cleansing composition plus the propellant, is such that the propellant comprises from about 20% to about 90%, preferably from about 25% to about 80%, and more preferably from about 30% to about 50%, of the total composition. Examples of propellants useful herein include those selected from the group consisting of chlorinated, fluorinated, and chlorofluorinated lower molecular weight hydrocarbons (nonlimiting examples of which are the freons); nitrous oxide; carbon dioxide; butane; propane; and mixtures thereof.

A conventional pump foam dispenser generally comprises a reservoir including an opening and adapted to contain a quantity of a foamable liquid, and a manually-actuable pump means adapted to fit partially inside of and sealably attached to the opening of the reservoir. The sealable attachment of the pump means normally comprises a set of mating threads on the housing of the pump means and on the opening of the reservoir. In addition to the pump for supplying the foamable liquid from the reservoir and the air, the pump means normally also includes a mixing chamber for mixing the foamable liquid and the air into a foam mixture and a flow regulating orifice through which the foam mixture passes. The pump means is also connected downstream with the dispensing nozzle for further refining and dispensing the resultant foam.

In the case of most manually-actuable pump foamers, the actuation by the user supplies both the foamable liquid and the air to the mixing chamber. The foamable liquid is usually dispensed by the pump to the mixing chamber at a fixed volume with each full stroke of the pump. A fixed volume of air can also be supplied to the mixing chamber by means of the same or a separate pump. Alternatively, a variable volume of air can be drawn into the mixing chamber by means of check valves and venturi suction created by the flow of the foamable liquid into the mixing chamber.

A preferred prior art pump foam dispenser is shown in Japanese Laid-Open Utility Model No. Hei 3-7963 (Daiwa Can Co., Ltd.). This publication discloses a dual chamber pump foam dispenser wherein the foamable liquid and the air are separately but simultaneously pumped to a mixing chamber, thereby providing a consistent ratio and quantity of liquid and air with each full actuation of the pump.

The foamable liquid and the air are mixed as they pass through the mixing chamber and are discharged through a flow restricting orifice in the mixing chamber. The flow restricting orifice exerts back pressure against the flow of the resulting foam from the mixing chamber, which generates turbulence and causes mixing inside the mixing chamber. The back pressure created by the flow regulating orifice also causes, to some extent, resistance to the manual actuation of the pump means, thereby providing the user who is applying a force to the actuating means with a sense of or feel of the rate of dispensing of the foam mixture. The flow regulating orifice can range in size, depending upon such factors as the intended amount of foamable liquid and air to be dispensed, the viscosity of the foamable liquid, etc. Typically, the flow regulating orifice is from about 1 mm to about 3 mm in diameter. The foam discharged from the foam regulating orifice, which passes out of the pump means through a pump discharge tube is called intermediate foam.

From the pump discharge tube, the intermediate foam typically enters into a foam dispensing nozzle, which is typically in the form of a conduit. The foam is at this point comprised of bubbles having a wide range of sizes. This foam typically passes through at least one homogenizing or refining means in the conduit before exiting the foam dispensing nozzle as a final foam ready for use by the user. Such refining means is typically a screen of about standard mesh size 100 or more. A screen is typically characterized by its mesh size, which is the number of openings (also called passageways) per linear inch counting from the center of any wire to a point exactly 1 inch distant. Equivalently, a screen can also be characterized by either its opening size and diameter of the wires, both of them specified in units of mils (thousandths of an inch) or mm, or its opening size, specified in units of mils (thousandths of an inch) or mm and its percentage open area. Finally, the total area of a screen normal to the flow of the foam consists of two parts: (1) the open area of the screen (also called the flow area), which is the area of all openings of the screen, and the area of the screen covered by all wires. Known conventional foam dispensing nozzles typically use a refining screen having a total area, normal to the flow of the mixture, of about 0.2 $cm^2$ to about 0.6 $cm^2$.

Some prior art workers have tried to further improve the quality of the foam mixture exiting the primary refining screen by passing it through a second refining screen (also called the final or discharge screen) positioned nearer to the discharge of the foam dispensing nozzle, as is shown in FIG. 2 of U.S. Pat. No. 4,932,567, Tanabe et al., issued on Jun. 12, 1990. Other examples of such conventional pump foam dispensers are disclosed in Japanese Utility Model Nos. Showa 60-24426 and Showa 63-21119, and U.S. Pat. No. 4,509,661, to Sugizaki et al., issued on Apr. 9, 1985. The typical total area of the discharge screens in such conventional foam dispensing nozzles, as measured normal to the flow of the foam, is about 0.2 $cm^2$ to 0.4 $cm^2$.

These dispensing nozzles and dispensers work satisfactorily, but they are not completely effective in dispensing a foam exhibiting characteristics which are generally preferred to users. Accordingly, there remains a need to improve the quality of foams generated from various types of foamable liquids. In particular, conventional pump or squeeze foamers are not well suited for forming thick, stable (also called persistent) and homogeneous foams from a thicker, more viscous foamable liquid especially one having a viscosity at the conditions of usage of about 50 centipoise (hereinafter referred to as "cps") or more. Although aerosol propellants and aerosol dispensers can be used with some success with such viscous foamable liquids, there is currently a keen interest in reducing or avoiding the use of such aerosol propellants, and dispensers which rely upon them, from an environmental standpoint.

OBJECTS OF THE INVENTION

Accordingly, it is an object of this invention to provide an improved foam dispensing nozzle which overcomes the aforementioned problems of the prior art nozzles. Another object of this invention is to provide an improved method for generating a thick, stable and homogeneous foam from a foamable liquid. Another object is to provide a foam refining device for use with manually-actuable foam dispensers, such as a pump foam dispenser or a squeeze foam dispenser, which will produce a thick, stable and homogeneous foam across the entire range of actuation conditions by the user. Still another object is to provide a manually-actuable pump foam dispenser which does not require excessive pressure (or equivalently, actuation force) by the user when pumping more viscous foamable liquids. Still another object is to improve the quality of foam from a viscous foamable liquid, or from a foamable liquid even when stored in its container at low ambient temperatures. Yet another object is to provide an improved foam dispensing nozzle which is economical, reliable in operation, and adaptable for use with various types of foam generating pumps and foam dispensers.

These objectives are achieved by practice of the methods and use of the improved foam dispensing nozzles as described, exemplified, and claimed hereinafter.

SUMMARY OF THE INVENTION

In general, the quality of the foam made from a foamable liquid is determined by assessing various foam quality attributes, such as: 1) the appearance of the foam as it is determined by the uniformity of the bubble size distribution, as well as by the actual bubble sizes, wherein small and uniformly sized bubbles are generally preferred; 2) the thickness of the foam as it is determined by the apparent foam viscosity, wherein a greater apparent foam viscosity is generally preferred; 3) the density of the foam; and 4) the drainage of the foamable liquid component from the final foam upon standing, wherein lack of drainage of the foamable liquid is generally preferred.

To better understand the factors that can affect the quality of a foam made from a foamable liquid, particularly a more viscous foamable liquid, from a manually-actuable pump foam dispenser, a study was made of the effects on foam quality of dispenser design, such as homogenizing and refining screen type and size, orientation, and shape, of foamable liquid composition and properties such as viscosity and dynamic surface tension, and of the manner in which the user actuates the pump means to dispense the foam (i.e., the actuation dynamics). The amount of manual force applied to the manually-actuable means for generating the foam was also examined.

Although each of the aforementioned factors to some extent affects the quality of the resulting foam, it has been discovered that the velocity of the foam passing through the foam refining means has a substantial beneficial effect upon the foam quality. Although not wishing to be bound by theory, it is believed that the velocity of the foam mixture passing through a foam refining means should not exceed a critical velocity value in order to improve the quality of the foam.

Therefore, the invention is to a foam dispensing nozzle for dispensing a final foam from a foamable liquid, comprising:

(a) an inlet conduit for receiving an intermediate foam consisting of a mixture of said foamable liquid and a gas;

(b) a velocity decreasing means connected in fluid communication with said inlet conduit for decreasing the velocity of said intermediate foam; and (c) at least one foam refining means connected in fluid communication with said velocity decreasing means for generating said final foam from said reduced-velocity intermediate foam.

The present invention further is for manually-actuable foam dispensers for producing and dispensing a high quality final foam from a foamable liquid and a gas, said foam being comprised of bubbles having a number-average diameter of about $D_1$, said dispenser comprising:

(a) a manually-actuable means for mixing a quantity of said foamable liquid with a quantity of said gas to produce an intermediate foam which comprises bubbles having a number-average diameter greater than about $D_1$ and a wider bubble size distribution than the final foam, at a volumetric flow rate Q which is dependent upon the speed of actuation of said manually-actuable means by the user; and (b) a foam dispensing nozzle comprising a conduit in fluid communication with said manually-actuable means for receiving the intermediate foam from said manually-actuable means; and at least one foam refining means located in said conduit, said foam refining means comprising a plurality of substantially uniformly-sized and evenly distributed passageways; wherein said intermediate foam passes through said passageways at a velocity, $V_2$, falling within the range of a minimum velocity, $V_{2,min}$, and a maximum velocity, $V_{2,max}$, wherein the conditions needed to cause bursting of said bubbles having a diameter larger than about $D_1$ are met.

The present invention further is a method for producing and dispensing a high quality final foam from a foamable liquid and a gas, said foam being comprised of bubbles having a number-average diameter of about $D_1$, comprising the steps of:

(a) mixing a quantity of said foamable liquid with a quantity of said gas to produce an intermediate foam at a volumetric flow rate Q; said intermediate foam comprises bubbles having a number-average diameter greater than about $D_1$ and a wider bubble size distribution than the final foam; and (b) passing said intermediate foam through at least one foam refining means which comprises a plurality of substantially uniformly-sized and evenly distributed passageways; wherein said intermediate foam passes through said passageways at a velocity, $V_2$, falling within the range of a minimum velocity, $V_{2,min}$, and a maximum velocity, $V_{2,max}$, wherein the conditions needed to cause bursting of said bubbles having a diameter larger than about $D_1$ are met,

BRIEF DESCRIPTION OF THE DRAWINGS

FIG. I shows a perspective view with a partial cutaway of one embodiment of a foam dispensing nozzle according to the present invention.

Figure 7:
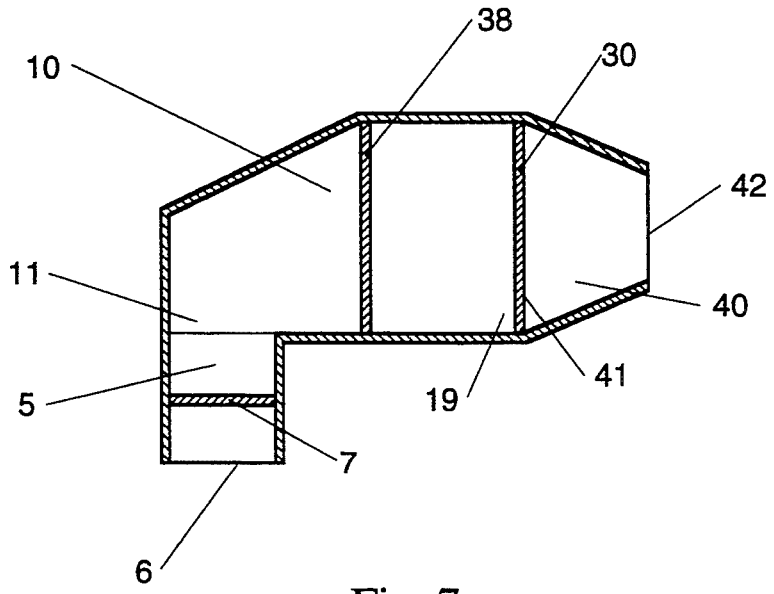
FIG. 7 shows a sectional view of a foam dispensing nozzle similar to the embodiment of FIG. 2*b*, said nozzle further including an intermediate foam refining means shown therein as a screen.

FIG, 8 shows a sectional view of a foam dispensing nozzle similar to the embodiment of FIG. 7, with a static mixer as an intermediate foam refining means.

Figure 9:
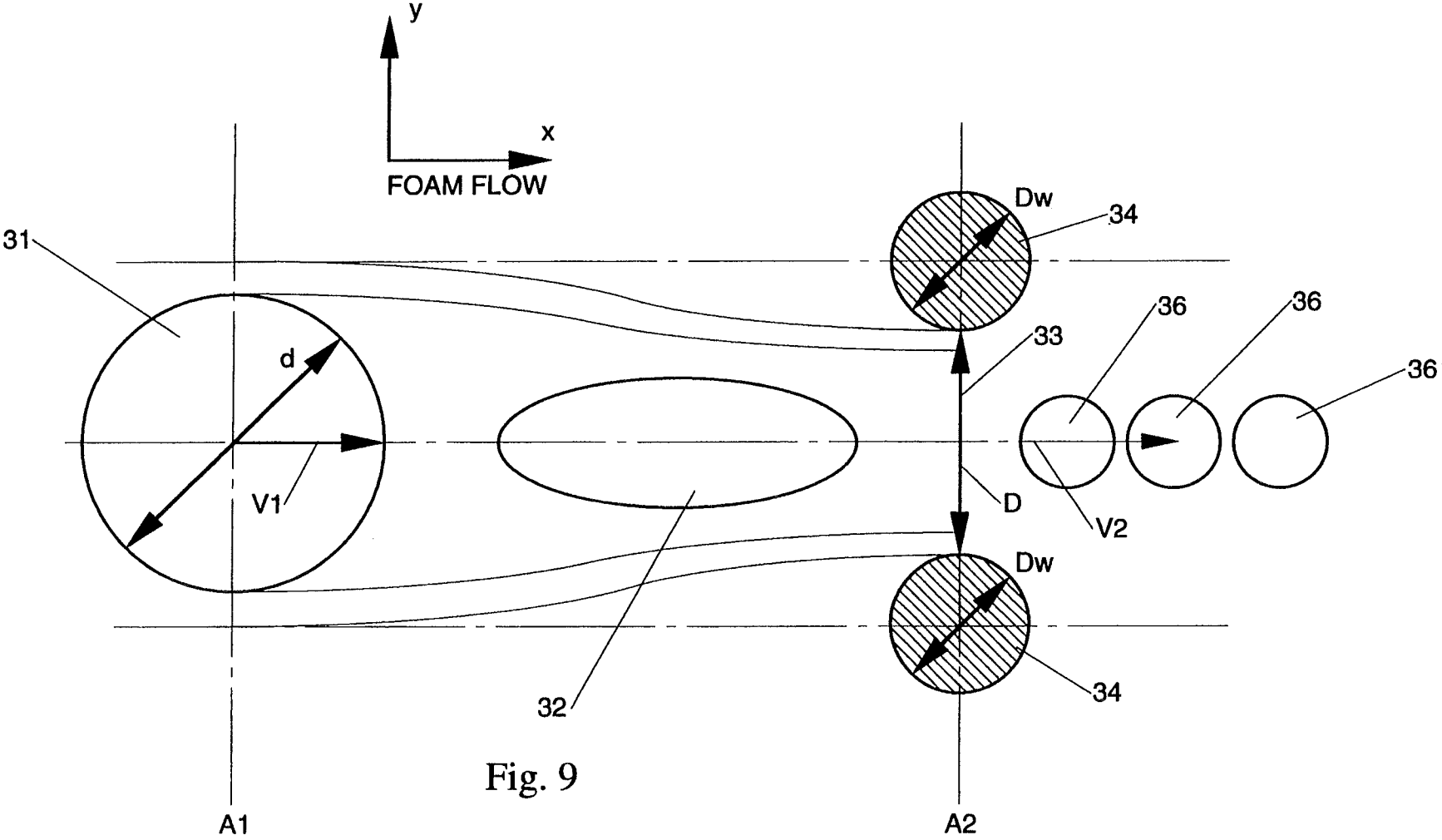

FIG. 9 shows a microscopic cross-sectional view (not in scale) of a single bubble undergoing extension and break-up into smaller bubbles while passing through a passageway of a foam refining screen.

Figure 10:
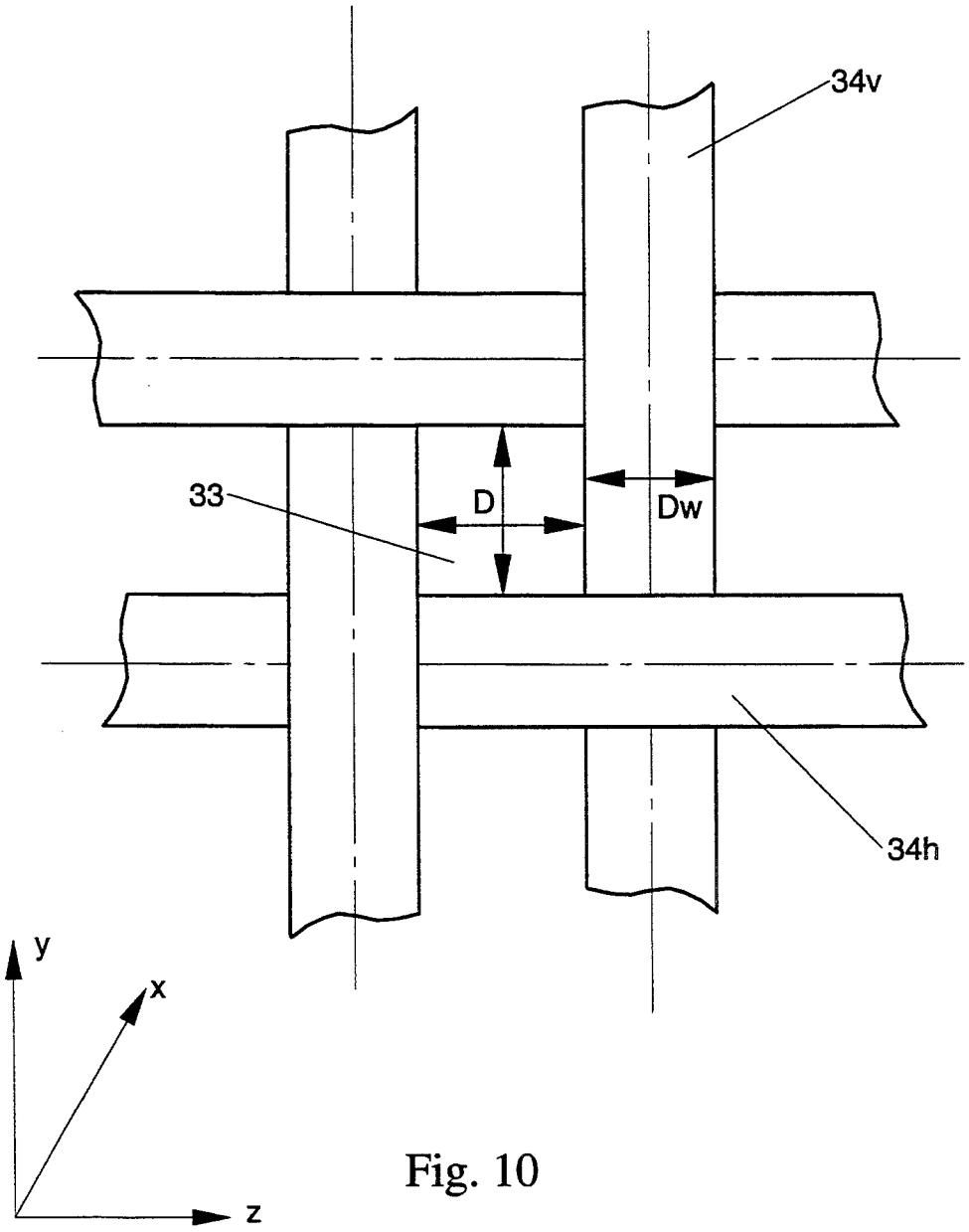

FIG. 10 shows the frontal view of a screen passageway of a foam refining screen.

DETAILED DESCRIPTION OF THE INVENTION

The manually-actuable foam dispenser and the method of forming and dispensing foam in accordance with the present invention will generally be described with respect to manually-actuable pump foam dispensers and foam refining means. One of ordinary skill, however, will readily recognize that the inventions described herein can be readily utilized with other types of manually-actuable foam dispensers, such as squeeze-bottle foam dispensers of the type generally described in Japanese Laid-Open Patent No. Showa 60-148468, as well as aerosol-type foam dispensers.

As used in the following discussion the velocity of a foam mixture through a conduit, $V_1$, is a calculated average velocity expressed in cm/sec and is determined by dividing the volumetric flow rate of foam generated by a foam-generating means, Q, in $cm^3$/sec, by the cross-sectional area (or flow area) of the conduit, $A_1$, in $cm^2$. The velocity of a foam mixture through the foam refining means, $V_2$, is a calculated average velocity expressed in cm/sec and is determined by dividing the same volumetric flow rate of the foam, Q, in $cm^3$/sec, by the open area of the foam refining means, $A_2$, in $cm^2$. In the case that the total area of the screen, $A_2$ (e.g. screen 30), is equal to the cross-sectional area of the conduit just prior to it, $A_1$ (e.g. cross-sectional area of 19), then $A_2$ is equal to the multiple of the percentage open area of the screen, k, and the cross-sectional area of the conduit just prior to the screen, $A_1$ (i.e., $A_2=kA_1$). For the purposes of the present discussion, the term "average velocity" will herein be referred to simply as "velocity". The actual velocity, $V_2$, may vary, for example, as the foam is compressed while passing through the passageways of the screen (i.e., Q changes as the foam passes through the foam refining means since it contains a large volume of gas, which is a compressible fluid). However, the calculated velocity $V_2$ is the most practical way of estimating the actual velocity of the moving foam and it is sufficiently accurate and reproducible to carry out the invention described herein.

Also discussed herein, the passageway size of the foam refining means, as measured perpendicular to its axis, is the length of the side of a square which has the same area as that of the particular passageway. Also, as used herein, a foam refining means having a given passageway size will preferably have less than about 5% of its total flow area comprised of passageways of greater than the given passageway size, preferably less than about 1%.

Foams containing relatively large diameter bubbles can be refined by forcing said foams through various foam refining means including screens, porous frits, porous media, static mixers and combinations thereof. In FIG. 9 a large diameter bubble 31, as makes up in part the foam, is shown approaching the foam refining means 30 of FIG. I along the x axis. FIG. 9 is drawn for demonstration purposes only, and is neither to scale nor does it show the actual concentration of bubbles which comprise said foam. As bubble 31 travels towards the screen 30, it undergoes deformation by a combination of extensional and shear fields existing between points $A_1$ to $A_2$ of FIG. 9 and it becomes the extended bubble 32. This extended bubble 32 undergoes further extension as it approaches even closer the passageway 33. FIG. 10 shows a frontal view of passageway 33, which is the void created by the intersection of horizontal wires 34*h* and vertical wires 34*v*. Furthermore, the effectiveness of said foam refining means depends on its ability to create the required extensional and shear fields for bubble break-up, and the strain rates generated by each of these fields, since their individual effectiveness is different. Predictions of the conditions which lead to bubble break-up are in part based on experimental work published by Karam, H. J., and J. C. Bellinger, *Deformation and Breakup of Liquid Droplets in a Simple Shear Field*, Ind. Engng Chem. Fundam., 7, 576–581 (1968), and Grace, H. P., *Dispersion Phenomena in High Viscosity Immiscible Fluid Systems and Application of Static Mixers as Dispersion Devices in Such Systems*, Chem. Engng Commun., 14, 225–277(1982); both of which are hereby incorporated by reference. Although Grace's work pertains to single drop or bubble deformation and break-up in (rotational or simple) shear and planar extensional (irrotational or pure shear) fields, the conditions which lead to bubble break-up in a concentrated dispersion of bubbles in a liquid continuous phase subjected to a combination of rotational and irrotational shear fields can still be applied, at least in a qualitative sense.

The following parameters are used by Grace and are also used in the present discussion:

Viscosity Ratio is the ratio of the viscosity of the dispersed phase, in this case air, to the viscosity of the continuous phase, that is the foamable liquid. The viscosity of air at 25° C. and pressure of 1 atm is taken from tables available in the literature, and is equal to $1.8\times10^{-2}$ cps. Typical values of the viscosity ratio for the purposes of the present invention range from about $1.8\times10^{-2}$ to about $6.0\times10^{-5}$ (for the viscosity of the foamable liquid ranging from about 1 cps to about 300 cps), more preferably from about $9.0\times10^{-4}$ to about $1.4\times10^{-4}$ (for the viscosity of the foamable liquid ranging from about 20 cps to about 130 cps), and most preferably from about $3.6\times10^{-4}$ to about $1.8\times10^{-4}$ (for the viscosity of the foamable liquid ranging from about 50 cps to about 100 cps).

Critical Shear Rate is the critical shear rate applied upon a bubble below which bubble break-up cannot be achieved. Although rotational and irrotational shear fields require different critical shear rates for bubble break-up (the rotational shear rate being much higher than the irrotational shear rate for low viscosity ratios; see FIG. 19 of Grace's work), for simplicity, shear rate as used hereinafter will mean either rotational or irrotational shear rates.

Critical Burst Time is the time required under critical shear rate for bubble break-up to take place.

Critical Draw Ratio is the necessary extension or deformation of the bubble at the critical shear rate for said bubble's break-up. The draw ratio is defined as the length of the extended bubble over the original bubble diameter.

For bubble break-up to occur at the critical shear rate, the following conditions should be met: (a) the bubble should experience the critical shear rate for time at least equal to its critical burst time, and (b) the bubble's draw ratio should be at least equal to its critical draw ratio. The specific values of (a) and (b) above can be estimated from Grace's work (specifically FIGS. 5, 9 and 10 for rotational shear fields and FIGS. 18, 22 and 24 for irrotational shear fields) for a certain viscosity ratio, dynamic surface tension of the foamable liquid, and original bubble diameter. When the actual shear rate exceeds the critical shear rate, then the bubble burst time is shortened and falls below the critical burst time and the bubble's draw ratio becomes greater than the corresponding bubble's critical draw ratio (see FIGS. 13 and 11 of Grace's work, respectively).

Foam flows through a foam refining means, such as a screen, wherein the bubbles approaching the opening 33 of the screen will be extended forming slender bubbles 32. Extension occurs because of the higher velocity $V_2$ over $V_1$ along the x axis, and the velocity differences along the y and z axes. $V_2$ is based on the open area of all passageways, i.e., the open area of the screen, $A_2$, which is equal to the total number of passageways, N, times the open area of one passageway, $a_2$. The open area of the passageways is considered to be of a square shape and equal to $D^2$, where D is the size (width or height) of the passageway. $V_1$ is based on the total area upstream from the screen, $A_1$ (also called the cross-sectional area of the conduit, or the flow area of the conduit) which is equal to the total number of passageways, N, times the area corresponding to one passageway, $a_1$. The area, $a_1$, corresponding to each passageway, is equal to $(D+D_w)^2$, $D_w$ being the diameter of the wire comprising the screen. The ratio of the open area of the screen, $A_2$, and the cross-sectional area of the conduit, $A_1$, is typically from about 15% to about 50%. Therefore, the velocity ratio of $V_2$ to $V_1$, which is equal to the ratio of $A_1$ to $A_2$, is typically from about 2 to about 7, if the compressibility effects on the velocity are neglected. Thus, when the shear rate is at least equal to the critical shear rate, and the bubble's residence time and draw ratio in the high shear region is at least equal to the corresponding values at the conditions of the actual shear rate the bubble bursts producing a number of smaller daughter bubbles.

The viscosity and dynamic surface tension of the foamable liquid, viscosity of the gas, flow area of the conduit, flow area of the refining means, diameter of the original bubble, and pump actuation dynamics (volumetric flow rate of the foam through the conduit) all play an important role for making quality foams. Based on the above mentioned conditions for bubble break-up, for all other conditions remaining the same (e.g. foamable liquid composition and its foamability), and neglecting any effect of the conduit flow area and its geometry on the bubble size and its distribution in the upstream position of the foam refining means, one expects that an increase of the conduit flow area results in increased residence time of the bubble in the high shear area upstream of the screen opening. Consequently, and to the extent that the shear rate exceeds the corresponding critical value and the conditions for the burst time and draw ratio are met, one expects that a bubble in the larger-conduit-flow-area case will break-up, whereas the same bubble in the smaller-conduit-flow-area case will not break since the condition for the burst time is not met.

Of course, a large increase of the conduit flow area might result in an actual shear rate lower than the corresponding critical value, in which case bubble break-up will not occur. Similarly, if a bubble of a certain diameter does not break when the viscosity of the foamable liquid is increased (the condition for the draw ratio is not met), an increase of the flow area of the conduit might result in a decrease of the ratio of the actual to the critical shear rates. This in turn decreases the required draw ratio (see FIG. 11 of Grace's work) and the probability of bubble break-up increases.

For a given conduit flow area, the effect of the foam volumetric flow rate depends on the characteristics of the foam dispenser (e.g. pump or squeeze foam dispensers) and the actuation dynamics of the user of the dispenser. Said effect of the foam volumetric flow rate can be estimated based on the above mentioned conditions. Thus, for a range of volumetric flow rates one expects that all conditions are met, which results in a high quality foam. However, at either low or high volumetric flow rates one or more of the conditions are not met (at least the shear rate condition or the burst time condition for the low volumetric flow rate case, and at least the burst time condition for the high volumetric flow rate case), which results in a poor quality foam.

The effect of the viscosity of the foamable liquid on the above mentioned range for high quality foam is understood from the theoretical approach discussed above. The higher the viscosity of the foamable liquid, the smaller the viscosity ratio. The smaller this ratio, the lower the critical shear rate. The lower the critical shear rate, the higher the ratio of actual to critical shear rates. The higher this ratio of shear rates, the higher the draw ratio, and the lower the burst time. Consequently, one expects that the volumetric flow rate range for high quality foam shifts lower for higher viscosity foamable liquids as compared to lower viscosity foamable liquids.

Finally, the effect of the screen itself can be better understood if application of the above conditions is made. A low-mesh (or coarse-mesh) screen is expected to generate low shear rate, and thus even if this shear rate exceeds the corresponding critical value, the ratio of the actual to critical values is expected to be low and thus the burst time is expected to be long. On the other hand, a very high-mesh (or fine-mesh) screen is expected to generate high shear rates, but not to meet the burst time condition.

The velocity of the foam through the foam refining means, $V_2$, can be considered to include all the above mentioned parameters, i.e., shear rate, residence time, and draw ratio. In general, higher velocity corresponds to higher values of shear rate and draw ratio, and lower residence time. For example, when $V_2$ is greater than $V_{2,max}$, then the residence time of the bubble in the high shear region is shorter than it needs to be for bursting, which bursting time corresponds to the ratio of the actual to the critical shear rates. Conversely, when $V_2$ is lower than $V_{2,min}$, then; (1) the actual shear rate does not exceed the critical shear rate, or (2) the actual shear rate does exceed the critical shear rate, but the residence time (and/or draw ratio) of the bubble in the high shear region is lower than the required burst time (and/or draw ratio). In other words, there is a range of foam velocity through the foam refining means, from $V_{2,min}$ to $V_{2,max}$, that is necessary for dispensing high quality foam. In the present invention the $V_2$ values necessary to achieve production of improved foam in context of the foam dispenser disclosed herein are preferably from about 15 cm/sec to about 400 cm/sec, and more preferably from about 20 cm/sec to about 350 cm/sec.

The quality of the foam is also affected by the use of additional foam refining means. For example, foams produced using a coarse-mesh screen 7 in the inlet conduit 5 of the foam dispensing nozzle (the inlet conduit is also called the stem of the nozzle) with a fine-mesh screen 30 close to the discharge end of the connecting conduit 10 of the nozzle can be improved by the addition of either an intermediate (third) screen (screen 38 of FIG. 7) or a static mixer (static mixer 39 of FIG. 8) in the connecting conduit 10, between the two original screens.

The nozzles containing an additional intermediate screen (i.e., three-screen nozzles) are capable of dispensing foams which are more persistent (i.e., with improved percent liquid drainage values) than foams generated from a two-screen nozzle. The selection of the intermediate screen, however, is critical for the production of distinguishable foams. For example, a three-screen nozzle with screens having mesh sizes corresponding to 100T, 183 by 264 (this is a dual mesh size screen, i.e., its mesh sizes along the z and y axes of FIG. 10 are not the same, in distinction with the square mesh size screen, wherein its mesh sizes along the z and y axes of FIG. 10 are the same), and 355T, dispenses a more persistent foam than a three-screen nozzle with screens of sizes 100T, 305, and 355T, using a 19 cps foamable liquid. The difference is believed attributable to the conditions for bubble break-up achieved by each screen. The 305 mesh intermediate screen has 41% open area. Such an open area is expected to reduce the ratio of actual to critical shear rates and consequently to increase the burst time and reduce the draw ratio. Based on the above, the probability of bubble break-up for larger bubbles is greater than that for smaller bubbles. Consequently, the liquid drainage data should be less sensitive to actuation dynamics, for the three-screen nozzle than for the corresponding two screen-nozzle.

On the other hand, the 183 by 264 mesh screen is expected to cause bubble break-up since its low percentage open area (21%) increases the ratio of actual to critical shear rates and consequently reduces the burst time and increases the draw ratio. Furthermore, the characteristics of the 183 by 264 intermediate screen, and the 355T discharge screen are similar, so that the shape of the curves for liquid drainage versus actuation dynamics is expected to be similar to one another. Consequently, any intermediate screen having a mesh size falling between those mesh sizes of the stem and the discharge screens is not necessarily beneficial to the dispensed foam.

The nozzle which contains a static mixer between the stem and the discharge screens can also dispense high quality foams from foamable liquids. The dispensed foams are more persistent that those from typical two-screen nozzles and less sensitive to actuation dynamics (i.e., liquid drainage and foam thickness data is constant and does not depend on how fast or slow the user actuates the dispenser, for a wide range of actuation dynamics). The static mixer provides shear rate and residence time for bubble break-up, it also breaks bubbles by the mechanism of flow division and finally, it homogenizes the dispersion of bubbles into the continuous liquid phase. As a result the intermediate foam which emerges out of the static mixer is expected to be homogeneous and to contain bubbles with a more uniform bubble size distribution and smaller average bubble size. Note that a smaller bubble requires higher critical shear rate and lower burst time and draw ratio to break-up, so that its burst is easier to achieve, as long as the actual shear rate exceeds the critical one. Finally, the discharge screen breaks the bubbles of the intermediate foam even further. The more elements that a static mixer system has, the better the bubble break-up and homogenization are achieved. However, there is a practical limit on the number of elements, since the length of the nozzle cannot exceed a certain limit and the pressure drop increases with the number of elements.

The effect of the pressure distribution along the flow path of the foam was not discussed, since an increased pressure drop along the flow path is expected to increase the strain rates that the bubbles experience and reduce the residence times of the bubbles. These phenomena have been discussed above in the context of the conditions for break-up and will not be further discussed. Finally, when comparing dispensers of the present invention with prior art dispensers one should utilize the same composition of foamable liquids. The reason for this being that variations of the composition of the foamable liquid (e.g. type of surface-active agents) can be responsible for variations in the quality of the foam even when using the same dispenser.

FOAM DISPENSING NOZZLE

The present invention also includes an improved foam dispensing nozzle (also called foam refining nozzle) for forming thick, stable and homogeneous foam from a mixture of a foamable liquid and a gas, otherwise known as a final foam. Such improved foam refining nozzle can be formed integrally with the manually-actuable foam, as mentioned above, or, as is described below, it can be sealably attached to a separate manually-actuable foam pump. Although the nozzle is described below as being attached to a manually-actuable foam pump, it is within the ability of persons skilled in this art to adapt the present invention for use with other foam dispensers, such as squeeze dispensers and aerosol dispensers.

The improved foam dispensing nozzle comprises:

(a) an inlet conduit for receiving an intermediate foam consisting of a mixture of a foamable liquid and a gas at a volumetric flow rate sufficiently high that it will produce an average incoming intermediate foam velocity which is too great to permit effective bubble bursting as said foam passes through at least one downstream foam refining means having a plurality of substantially uniformly-sized and evenly distributed passageways therethrough; and (b) a velocity decreasing means placing said inlet conduit in fluid communication with a foam refining means, wherein said velocity decreasing means lowers the average velocity of said intermediate foam so that when said foam passes through said foam refining means it is at a velocity no greater than about 300 cm/sec.

In the practice of this aspect of the present invention, the intermediate foam can be generated and discharged to the nozzle by any conventional means, although the use of a manually-actuable foam pump is preferred.

Figure 1:
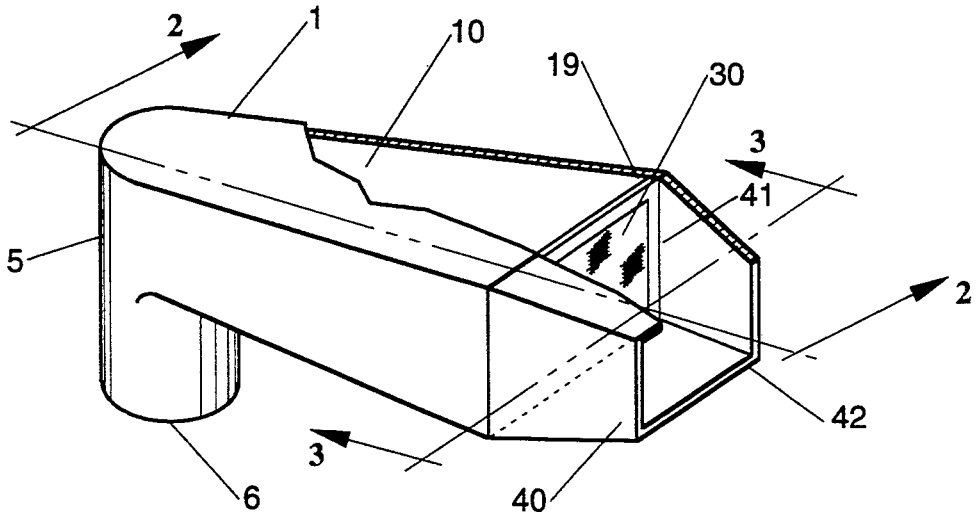

FIG. 1 shows an embodiment of the improved foam refining nozzle 1 of the present invention.

(a) Inlet Conduit

The inlet conduit 5 provides fluid flow transition from a discharge of a foam pump means, such as a pump discharge tube (not shown). In FIG. 1, inlet conduit 5 has circular cross section to fit snugly and sealably over the cylindrical pump discharge tube of a foam pump. The inlet conduit 5 can also be any other useful shape, size, length, or configuration which serves the purpose of adapting the nozzle 1 to a foam pump. Optionally, a foam homogenizing screen 7, as previously described, can be mounted inside the inlet conduit to improve the homogeneity of the foam mixture entering the nozzle 1. This screen has an effective pore opening size of about 0.150 mm to 0.200 mm, and is typically a 100 mesh-type screen.

(b) Expanded Conduit and Foam Refining Means

A preferred embodiment herein provides a foam refining nozzle wherein the velocity decreasing means comprises a volume expanding means. The volume expanding means causes the velocity of the intermediate foam to be reduced as the advancing foam expands in the plane perpendicular to the direction of flow. The expanded conduit 10 is in fluid flow communication only with the inlet to the nozzle and with the foam refining means 30, and provides for passage of the entire foam mixture from the inlet of the nozzle to the screen. There is no intention that additional foamable liquid or air be introduced into the expanded conduit, or for any portion of the foamable mixture to be discharged from the expanded conduit prior to passage of the mixture through the screen.

The expanded conduit 10 has a cross-sectional area at its outlet 19 which is at least larger than the cross-sectional area of the inlet 6. As used herein, the cross-sectional area of the inlet 6 or the outlet 19, or at any point along a conduit, is the area of a plane through which the foam mixture can pass which is, perpendicular to the flow of fluid through such area. Preferably, the ratio of the cross-sectional areas of outlet of the expanded conduit 19 to inlet 6 of the inlet conduit is from about 2:1 to about 12:1, more preferably from about 2:1 to about 8:1, and most preferably from about 4:1 to about 8:1. The cross-sectional shape of the expanded conduit 10 can be square, rectangular, oval, or any other shape that provides efficient flow of the intermediate foam from the inlet conduit 5 to the porous foam refining means 30. A typical cross-sectional shape is a rectangle having a height to width ratio of from about 1:1.5 to about 1:2. Though ordinarily the cross-sectional shape along the entire length of the expanded conduit 10 will not change, there is no limitation to changing from, for example, a rectangular shape near the inlet portion 11 of conduit 10 to oval shape near the outlet 19. The selection of the specific shape and geometry of the expansion conduit 10 will also take into account its aesthetic design and functionality (that is, how easily and conveniently the foam pump is operated). Preferably, the cross-sectional area along the expanded conduit 10 will be increased gradually, from the inlet to the outlet 19, However, the expanded conduit can also be constructed such that the expansion of the conduit occurs abruptly anywhere along the length of the expanded conduit, such as at the inlet 11 or at the outlet 19.

Figure 2A:
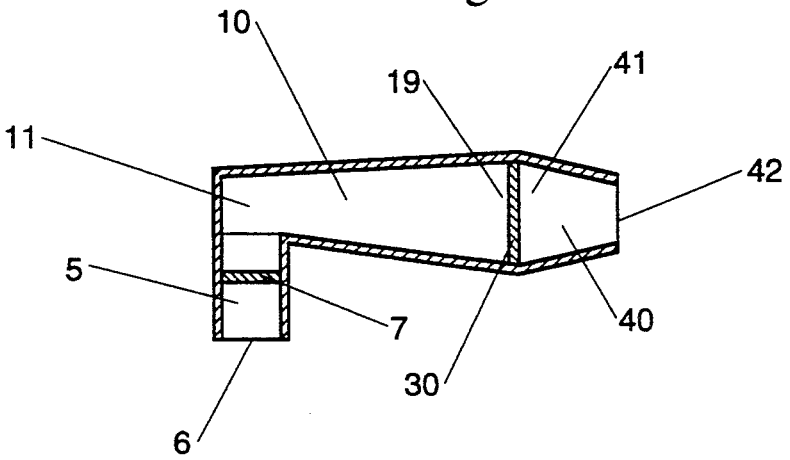
FIG. 2*a* shows a sectional view of the foam dispensing nozzle of FIG. 1 through line 2—2.
Figure 2B:
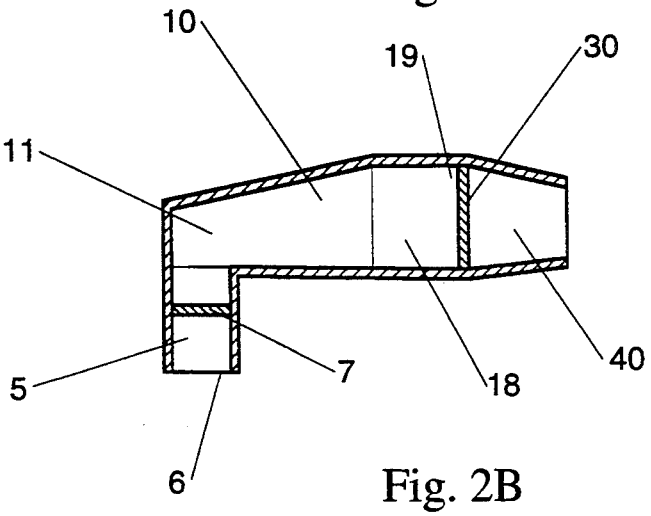
FIG. 2*b* shows a sectional view of an alternative embodiment of FIG. 1 through line 2—2.
Figure 3:
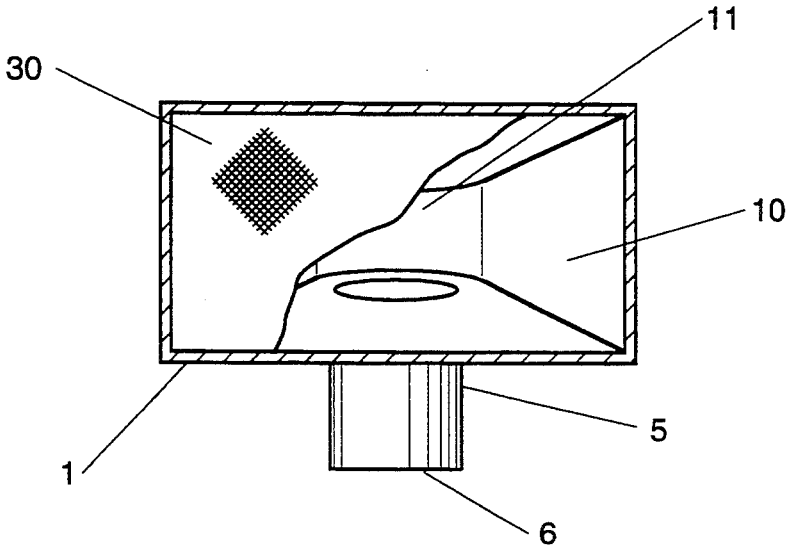
FIG. 3 shows a sectional view of the foam dispensing nozzle of FIG. 1 through line 3—3.

The outlet 19 of the expanded conduit 10 is in fluid communication with the foam refining means 30. The outlet 19 can be the terminus of the expanding cross section of the conduit 10, as shown in FIG. 2*a* and FIG. 3, or can be the outlet of connecting portion 18 as shown in FIG. 2*b*.

Figure 5:
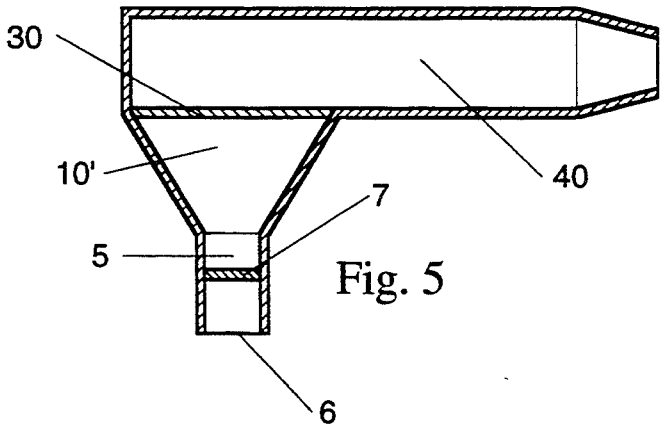
FIG. 5 shows a sectional view of still another embodiment of a foam dispensing nozzle according to the present invention.
Figure 6:
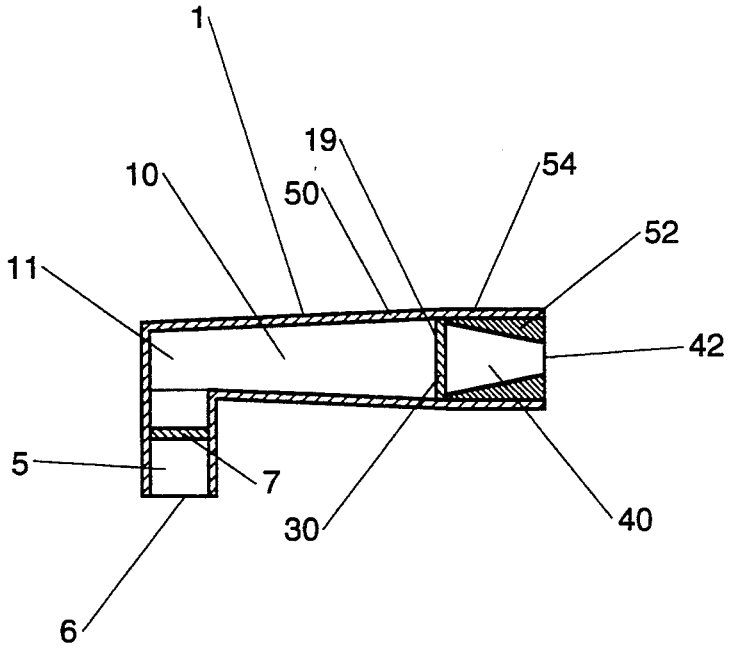
FIG. 6 shows a sectional view of yet another embodiment of a foam dispensing nozzle of the present invention.

Depending on the type of foam dispensing package used and the desired application, the expanded conduit 10 can be oriented in either the horizontal (as shown in FIG. 1) or the vertical (as shown in FIG. 5), or an orientation in between. In normal use, a manually-actuable pump foam dispenser is oriented horizontally in the expanded conduit 10.

The intermediate foam exits at a reduced velocity from the expanded conduit 10, and enters and passes through a porous foam refining means 30. The total cross-sectional area of the porous foam refining means 30 through which the foam mixture can flow is preferably substantially the same as the cross-sectional area of the outlet 19.

The refining means described herein above is generally sufficient for use with the present embodiment. The refining means is preferably a meshed screen. The refining screen 30 has a plurality of substantially uniformly-sized and evenly distributed passageways having a maximum dimension typically less than about 0.175 mm as measured perpendicular to its axis, preferably in the range of about 0.020 mm to about 0.120 mm, more preferably in the range of about 0.035 mm to about 0.080 mm, and most preferably in the range of about 0.035 mm to about 0.060mm.

The total refining screen area can range from about 0.5 $cm^2$ to about 10 $cm^2$, more preferably from about 1 $cm^2$ to about 2 $cm^2$.

After the foam mixture passes through refining screen 30 and a final foam is generated, the final foam may be discharged through an optional outlet conduit 40. A short, converging optional outlet conduit 40 is typically used with the present invention, having an inlet 41 communicating with and adjacent to the outlet surface of the refining screen 30, and an outlet 42 for discharging the foam to the user's hand or other implement for use. A converging discharge 40 provides the discharged foam with increased velocity and momentum to satisfy the consumer's desire and expectation, and to provide a clean, sharp break of the dispensed foam at the end of the dispensing stroke from the foam which remains inside the dispensing device. The shape and convergence of the discharge conduit is selected to avoid diminishing the quality of the foam that has been generated. Typically, the outlet 42 is an opening of from about 0.5 $cm^2$ to about 2 $cm^2$. The configuration of the discharge conduit and the shape of the opening of the outlet 42 can be selected to satisfy both aesthetic and functional needs for the foam dispenser.

The optional outlet conduit can be a separate component which is sealably and either permanently or removably attached to the outlet 19 of the expanded conduit 10. In the manufacture of the nozzle 1, the optional outlet conduit 40 is usually attached after the refining screen 30 has been positioned or secured in place, The screen can be secured to either the expanded conduit 10, or to the optional outlet conduit 40, or it can simply be held in place between the two pieces when the optional outlet conduit 40 is attached to the expanded conduit 10.

In a preferred embodiment, a foam dispensing nozzle as shown in FIG, 6 is made by attaching the refining screen 30 to the optional outlet conduit 40 at its inlet end 41, thereby forming a screen insert 52. The housing 50 of the nozzle 1 extends beyond the expanded conduit outlet 19 to form an insert sleeve 54. The screen insert 52 is then inserted into and sealably affixed within the insert sleeve 54 such that the screen 30 is positioned at the expanded conduit outlet 19.

The optional outlet conduit can also be made integral with the nozzle 1. In this case, the screen is preferably inserted into position through a slot in the wall of the device at expanded conduit outlet 19 and then sealed and secured in place.

The inlet conduit 5, the expanded conduit 10, and the optional outlet conduit 40, as well as the remaining housing of nozzle 1, can be made by conventional molding or casting methods, and are most conveniently a plastic material, such as polyester, polypropylene, polyethylene, high density polyethylene, or linear low density polyethylene. Polypropylene is preferred.

MANUALLY-ACTUABLE FOAM DISPENSERS

The present invention embodies various manually-actuable foam dispensers including aerosol dispensers, squeeze dispensers and pump dispensers. Preferred are manually-actuable squeeze dispensers and pump dispensers, most preferably pump dispensers.

The manually-actuable foam dispensers of the present invention are capable of producing and dispensing a high quality final foam from a foamable liquid and a gas, said foam being comprised of bubbles having a number-average diameter of about $D_1$, said dispenser comprising:

(a) a manually-actuable means for mixing a quantity of said foamable liquid with a quantity of said gas to produce an intermediate foam which comprises bubbles having a number-average diameter greater than about $D_1$ and a wider bubble size distribution than the final foam, at a volumetric flow rate Q which is dependent upon the speed of actuation of said manually-actuable means by the user; and (b) a foam dispensing nozzle comprising a conduit in fluid communication with said manually-actuable means for receiving the intermediate foam from said manually-actuable means; and at least one foam refining means located in said conduit, said foam refining means comprising a plurality of substantially uniformly-sized and evenly distributed passageways; wherein said intermediate foam passes through said passageways at a velocity, $V_2$, falling within the range of a minimum velocity, $V_{2,min}$, and a maximum velocity, $V_{2,max}$, wherein the conditions needed to cause bursting of said bubbles having a diameter larger than about $D_1$ are met.

(a) Manually-Actuable Means

The manually-actuable means for mixing a quantity of said foamable liquid with said gas to produce a foam comprised of bubbles having a number-average diameter larger than about $D_1$ and a wider bubble size distribution than the final foam, is preferably capable of discharging the resulting foam at a volumetric flow rate in the range of about 4 $cm^3$/sec to about 140 $cm^3$/sec, and more preferably about 14 $cm^3$/sec to about 40 $cm^3$/sec, depending upon the speed of actuation of the manually-actuable means by the user. This range of volumetric flow rates is normally about right for skin and hair care products and cleaning products, such as hand soap, shampoo, body soap, hair mousse, shaving foam and kitchen cleanser. Among the means used in the present invention are those well known in the art for bringing the liquid and air together to be mixed into a foam, e.g., aerosol canisters, deformable reservoirs, and foam pump which are squeezed or actuated by the user to express the foamable liquid and air into a mixing chamber. Pump foamers are preferably used herein, most preferably pump foamers which are manually-actuable by applying force to the top of the pump stem, thereby mixing liquid and gas at each stroke. Examples of these particularly preferred foam pumps are shown in Japanese Laid-Open Utility Model No. Hei 3-7963 (Daiwa Can Co., Ltd.). This publication discloses a dual chamber foam dispenser, wherein the foamable liquid and the air are separately but simultaneously pumped into the mixing chamber, thereby providing a consistent ratio and quantity of liquid and air with each full stroke actuation of the pump.

Although a user can actuate a foam dispensing pump, or a squeeze foam dispensing package, across a broad range (for example, for a manually-actuable pump, from about 0.2 seconds per pump stroke to about 3 seconds per pump stroke), under typical use conditions the pump is actuated at a rate of from about 0.35 seconds to about 2.2 seconds per stroke, more preferably from about 0.5 to about 1.4 seconds per stroke. The volume of foam dispensed with each full stroke of the pump can be varied depending upon the concentration of the foamable liquid to be used by the end user, and the amount of air to be mixed with the liquid to generate the foam. Conventional foam pumps can be used in the practice of the present invention. Conventional foam pumps typically dispense a volume of foam from about 10 $cm^3$ to about 50 $cm^3$, more typically about 20 $cm^3$, with each full pump stroke. Therefore, the volumetric flow rate of foam, Q, which is typically dispensed from a manually-actuable pump typically ranges from about 4 $cm^3$/sec to about 140 $cm^3$/sec, more typically from about 14 $cm^3$/sec to about 40 $cm^3$/sec.

(b) Foam Dispensing Nozzle

Figure 8:
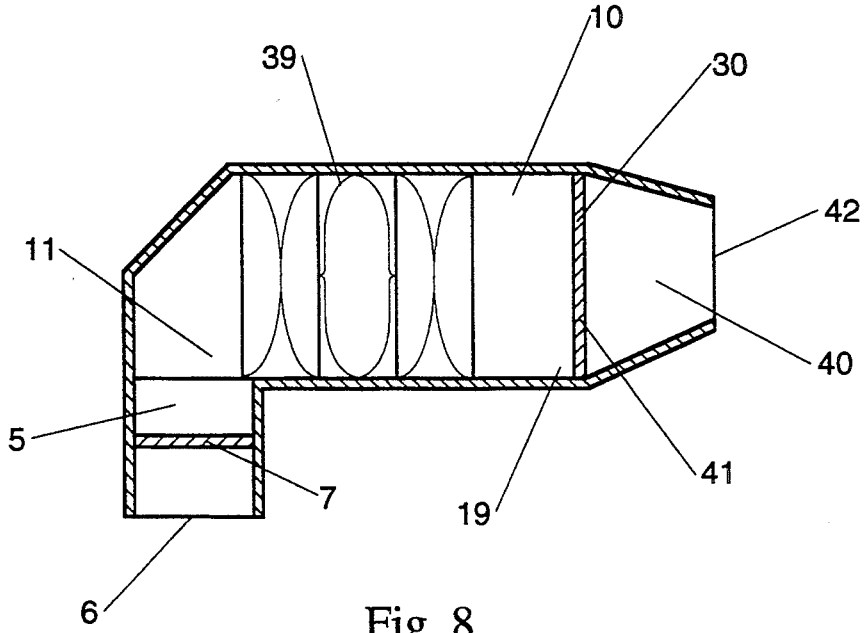

The foam dispensing nozzle according to FIG. 8 comprises an inlet conduit 5, optional outlet conduit 40 and connecting conduit 10 in fluid communication with said manually-actuable means for receiving the intermediate foam from said means; and a foam refining means located at the discharge end of said connecting conduit 10, said foam refining means comprising a plurality of substantially uniformly-sized and evenly distributed passageways; wherein said intermediate foam passes through said passageways at a velocity, $V_2$, falling within the range of a minimum velocity, $V_{2,min}$, and a maximum velocity, $V_{2,max}$, wherein the conditions needed to cause bursting of said bubbles having a diameter larger than about $D_1$ are met.

The foam dispensing nozzle has an inlet opening for receiving the intermediate foam from the pump means and at least one foam refining means having a plurality of substantially uniformly sized and distributed passageways extending therethrough, said foam refining means being in fluid communication with said inlet, and an outlet opening for discharging the resulting final foam to the user. The connecting conduit provides for the passage of the entire foam mixture from the inlet opening 6 through to the outlet opening 42 where it is discharged for use by the consumer. The cross-sectional shape of the connecting conduit can be square, rectangular, oval, or any other shape that provides efficient flow of the intermediate foam from the inlet opening of the conduit to the foam refining means. The typical cross-sectional shape is rectangular having a height to width ratio of from about 1:1.5 to about 1:2. The linear distance along the centerline of the connecting conduit from the inlet to the outlet will typically be about 5 mm to about 100 mm, more preferably from about 20 mm to about 40 mm.

The foam refining means can comprise a screen, a porous ceramic frit, or other suitable rigid or semi-rigid porous structure and material. Preferably, a screen is used because it is inexpensive, easy to handle in construction, thin and compact, and can provide openings of very small size. Hereinafter, the foam refining means will be generally referred to as refining screen. This screen can also be referred to as the final (or discharge) screen, since the foam discharged therefrom generally passes directly from the device through the outlet of the conduit, as described below.

The screen used as the foam refining means of the present invention comprises a plurality of substantially uniformly-sized and evenly distributed passageways extending therethrough. Each passageway of the screen has an axis and a maximum dimension typically less than about 0.175 mm as measured perpendicular to its axis, preferably in the range of about 0.020 mm to about 0.120 mm, more preferably in the range of about 0.035 mm to about 0.080 mm, and most preferably in the range of about 0.035 mm to about 0.060 mm. FIG. 10 shows an isolated passageway formed by intersecting wires 34*v* and 34*h*.

The percent open area of the foam refining means, typically a screen, is preferably from about 15% to about 50%, more preferably from about 20% to 40%.

Figure 4:
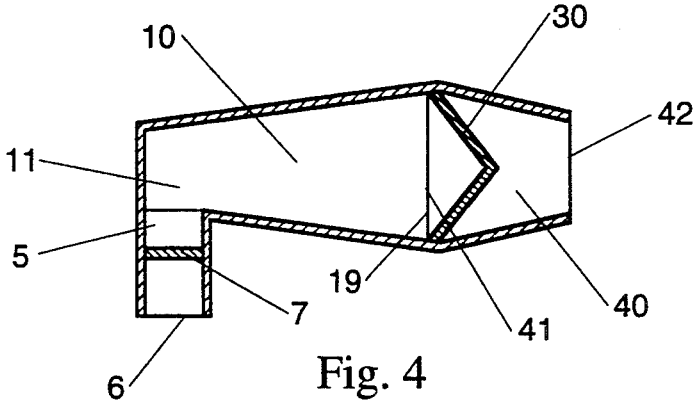
FIG. 4 shows a sectional view of another embodiment of a foam dispensing nozzle according to the present invention.

Preferably, the screen is planar and oriented in the connecting conduit so that the axis of each of the passageways in the refining means is substantially aligned with the direction of flow through the conduit. Nevertheless, the shape of the screen can also be concave or convex with the flow of the foam mixture, or it can be a tapered cone or pyramid as shown in FIG. 4, or can be positioned as a slanted plane in the conduit, diagonally relative to the direction of fluid flow. In most applications, a planar screen positioned normal to the foam flow is preferred.

In the present invention it is preferred that the foam refining means is a meshed screen comprising a plurality of substantially uniformly-sized and evenly distributed passageways; each of the passageways having an axis; and each of the passageways also having a maximum cross-sectional dimension D in the range of about 10% to about 40% of the number-average bubble diameter $D_1$, more preferably in the range of about 10% to about 20% of the number-average bubble diameter $D_1$ of the final foam, as measured perpendicular to its axis, and a length of the passageway, $L_p$, of at least about 40% of the maximum cross-sectional dimension D, as measured parallel to its axis. The screen is oriented within the conduit so that the axis of each of the passageways in the screen is generally aligned with the direction of flow through the conduit. The refining screen has a total area corresponding essentially to that of the connecting conduit at the point where the foam refining screen is located. The refining screen is provided with a sufficient number of passageways such that the total flow area provided in the refining screen is between about 1/7 and about ½, more preferably between about 1/5 and about 4/10 of the cross-sectional area of the connecting conduit, as measured at the point where the foam refining screen is located, whereby the ratio of the average foam velocity $V_2$ through each of the passageways in the screen to the average foam velocity $V_1$ just prior to entry into the passageways in the screen is from about 2 to about 7, more preferably from about 2.5 to about 5 for any volumetric flow rate Q of the foam.

A suitable meshed screen is supplied by NBC Industries Co., Ltd., (Tokyo, Japan), and ranges from about No. 100T (D of about 0.183 mm, and 52% open area) and finer; preferably from about No. 150T (D of about 0.120 mm, and 46% open area) to about No. 460T (D of about 0.022 mm, and 16% open area); more preferably from about No. 200S (D of about 0.082 mm, and 42% open area) to about No. 355T (D of about 0.037 mm, and 26% open area). The screen can also have wires in one direction which are different in type or count than the wires in the perpendicular direction. An example of such a screen is a dual-mesh screen, such as a 183 by 264 mesh screen having a 0.053 mm opening and 21% open area.

The total screen area can range from about 0.5 $cm^2$ to about 10 $cm^2$, preferably from about 1 $cm^2$ to about 3 $cm^2$, and more preferably from about 1 $cm^2$ to about 2 $cm^2$.

In yet another preferred embodiment, for the same intermediate foam and for a foam refining means having an effective passageway diameter D of from about 0.030 mm to about 0.080 mm, a high quality final foam can be made by passing said foam through the refining means at a velocity $V_2$ of about 300 cm/sec or less. As the velocity of the entering foam mixture exceeds this velocity range, the foam quality becomes poorer; that is, large bubbles can result and/or discrete streams of liquid can readily drain from the resulting foam. Preferably, a refining screen is used having a passageway diameter D from about 0.037 mm to about 0.060 mm, and a percent open area from about 26% to about 36%.

The number of passageways in the refining screen, and thus the total area of the screen, must be sufficient to produce a foam velocity $V_2$ through each of the passageways that is greater than the minimum velocity $V_{2,min}$, but not greater than the maximum velocity $V_{2,max}$, even when the volumetric flow rate of the foam through the screen is as low as about 4 $cm^3$/sec, and as high as about 140 $cm^3$/sec.

Another embodiment of the present invention which can achieve the objective of the above-defined pump foam dispenser provides for a foam refining means positioned in the connecting conduit which is of sufficient cross-sectional area, and of sufficient open area, to enable the intermediate foam which is discharged by the foam pump to be sufficiently reduced in velocity prior to passing through the refining screen and while flowing through the passageways of the refining screen so as to achieve an improved quality foam. Such pump foam dispenser comprises an integrally-mounted foam refining nozzle as previously described.

Yet another embodiment of the present invention further comprises a second foam refining means located in the inlet conduit of the foam dispensing nozzle. In yet another embodiment of the present invention the second foam refining means comprises a meshed screen having a plurality of substantially uniformly-sized and evenly distributed passageways.

OVER-SIZED FOAM PUMP DISCHARGE TUBE

Another embodiment of such a pump foam dispenser comprises manually-actuable pump means which comprises an over-sized pump discharge tube, such that the volume of foam mixture exits from the pump discharge tube at a velocity much slower than that velocity from a conventional, manually-actuable foam pump, operating under the same pump actuation conditions. For a typical foam volume of 20 $cm^3$ (per one stroke) and a 0.5 second per stroke pump actuation rate (fastest typical actuation rate), the cross-sectional area of such over-sized pump discharge opening should be at least about 0.4 $cm^2$. More preferably, a cross-sectional area of about 0.8 $cm^2$ or more, usually 0.8–5 $cm^2$, is used to provide a foam mixture discharge velocity from the pump discharge tube of about 20–50 cm/sec. The foam dispensing nozzle which is attached to the over-sized pump discharge tube will generally have a conduit of the same cross-sectional area as the discharge tube, although an expanded conduit section can be used to further reduce the velocity of the foam mixture prior to entering a final screen. Likewise, the total area of the refining screen will generally have the same or larger area as that of the discharge tube; that is, from about 0.8 $cm^2$ or larger. It would not generally be desirable to increase the velocity of the foam mixture prior to passing it through the final refining screen. A refining screen as herein above defined is used to form the final foam which is dispensed to the user. Using a refining screen having a total area of 0.8 $cm^2$ or larger provides a velocity through the refining screen of less than about 200 cm/sec when pumping such foam at a typical foam volumetric flow rates of from about 12.5 $cm^3$/sec to about 40 $cm^3$/sec. Although such pump foam dispenser is particularly useful with foamable liquids having a usage viscosity of about 50 cps or more, it can also be used with foamable liquids of any viscosity to form a stable and homogeneous foam.

INTERMEDIATE FOAM REFINING MEANS

As discussed above, a single refining screen is ordinarily sufficient to practice the present invention, although a second refining screen in the inlet conduit can also be used. However, one or more intermediate foam refining means located in the connecting conduit between the second foam refining means and the foam refining means located at the discharge end of the connecting conduit of the foam dispensing nozzle can be used to improve the quality of the intermediate foam entering the final refining means, primarily by reducing the number of large-diameter bubbles and by narrowing the bubble size distribution, which in turn result in an improvement of the quality of the final foam. For example, a foam produced using a coarse-mesh homogenizing screen 7 in the inlet conduit of the foam dispensing nozzle in combination with a fine-mesh refining discharge screen at the discharge end of the connecting conduit of the nozzle can generally be improved by adding either an additional intermediate screen or a static mixer between the two original screens.

The connecting conduit which houses the intermediate and discharge foam refining means can have the same cross-sectional area along the flow path of the intermediate foam (i.e., between the inlet of the connecting conduit and its outlet 19), or an expanding cross-sectional area with various rates and degrees of expansion. The total cross-sectional area of the intermediate foam refining means can range from about 0.5 $cm^2$ to about 10 $cm^2$, preferably from about 1 $cm^2$ to about 3 $cm^2$, and more preferably from about 1 $cm^2$ to about 2 $cm^2$. The intermediate foam refining means is selected from the group consisting of meshed screens, static mixers and combinations thereof. In one embodiment the intermediate foam refining means comprises a meshed screen; and in yet another embodiment the intermediate foam refining means comprises a static mixer.

FIG. 7 shows an intermediate foam refining means as a screen 38 mounted in the connecting conduit 10 upstream of the final screen 30. The intermediate screen 38 can be placed at any position between the inlet of the connecting conduit 10 and the outlet 19. Intermediate screen 38 generally meets the bubble break-up conditions established for the discharge screen 30 as discussed above. A dispensing nozzle using an intermediate screen is generally capable of improving the persistence of the foam. The selection of the intermediate screen can be optimized based on the properties of the foamable liquid, the configuration of the final refining screen and the conditions discussed above. For example, a three-screen foam refining nozzle with screens having mesh sizes corresponding to 100T, 183 by 264 dual, and 355T (inlet, intermediate, and final refining screens) and using a 19 cps foamable liquid, dispenses a foam which is more persistent than that dispensed from a three-screen nozzle with screens of mesh sizes 100T, 305, and 355T. The latter foam is approximately as persistent as the foam dispensed from the same foam dispensing nozzle but without the 305 intermediate screen. The two intermediate screens have the same passageway opening D (0.053 mm); but the 305 mesh intermediate screen has 41% open area, whereas the 183 by 264 dual-mesh screen has only a 21% open area. The difference is believed attributable to whether or not the conditions for bubble break-up are achieved for each intermediate screen.

The percentage open area of the intermediate meshed screen is preferably from about 10% to about 40%, and more preferably from about 15% to about 30%. The intermediate screen has a plurality of uniformly-sized and evenly distributed passageways having a maximum dimension as measured perpendicular to its axis, preferably in the range of about 0.020 mm to about 0.120 mm, more preferably in the range of about 0.035 mm to about 0.080 mm, and most preferably in the range of about 0.035 mm to about 0.060 mm. In one embodiment of the present invention, the intermediate foam refining means comprises a meshed screen; and wherein the dimension D of the substantially uniformly-sized and evenly distributed passageways ranges from about 5% to about 20% of the number-average bubble diameter $D_1$ of the final foam. For foamable liquids having viscosity from about 20 cps to about 80 cps, the $V_{2,min}$ is preferably from about 15 cm/sec to about 30 cm/sec, and more preferably from about 20 cm/sec to about 30 cm/sec; and the $V_{2,max}$ is preferably from about 100 cm/sec to about 350 cm/sec, and more preferably from about 100 cm/sec to about 300 cm/sec.

FIG. 8 shows the intermediate refining means as static mixer 39. Static mixers, also referred to as motionless mixers, are known in the fluid mixing art and can be made of various materials and in many sizes and shapes. A preferred static mixer can have two or more helical elements, arranged in alternating left- and right-hand pitch. An example of such a static mixer is a three-element Kenics Static Mixer, having a diameter of 1.27 cm (0.5 in.) and a length of 3.81 cm (1.5 in.). Since commercially-available static mixers usually have a round cross section, it is preferred to use a connecting conduit also having a round cross section to accommodate the static mixer.

A nozzle which includes a static mixer as an intermediate foam refining means can also dispense quality foams from foamable liquids ranging in viscosity from about 20 cps to about 130 cps. The dispensed foams are more persistent that those from typical two-screen nozzles and less sensitive to actuation dynamics (i.e., liquid drainage and foam thickness data is generally more constant and does not depend on how fast or slow the user actuates the pump). The static mixer provides shear rate and residence time for bubble break-up and can also break bubbles by the mechanism of flow division. The static mixer can also homogenize the dispersion of bubbles into the continuous liquid phase. As a result the foam which emerges out of the static mixer can be expected to be homogeneous and to contain bubbles with a more uniform bubble size distribution and smaller average bubble size. The final refining screen breaks the bubbles even further.

For foamable liquids having viscosity from about 20 cps to about 80 cps, the $V_{2,min}$ is preferably from about 15 cm/sec to about 40 cm/sec, and more preferably from about 20 cm/sec to 40 cm/sec; and the $V_{2,max}$ is preferably from about 200 cm/sec to about 400 cm/sec, and more preferably from about 200 cm/sec to about 350 cm/sec.

The more elements that a static mixer system has, the better the bubble break-up and homogenization that are achieved. However, there is a practical limit on the number of elements that can be employed. The extent to which intermediate foam refining means (e.g. screens and static mixers) are employed is determined by practical limitations such as costs, aesthetics, and physical or mechanical considerations. The physical or mechanical considerations referred to above concern the necessary force needed to actuate the foam dispenser. Specifically, placing any foam refining means in the conduit prior to the final foam refining means can increase back pressure, resulting in increased resistance to manual operation of the pump means. Therefore, the intermediate foam refining means should only be used to the extent that it does not create user-objectionable effort to pump the dispenser.

METHOD OF MAKING IMPROVED FOAM

The present invention includes a method for producing and dispensing a high quality foam from a foamable liquid, provided that the velocity $V_2$ of the foam from said foamable liquid is within the range of $V_{2,min}$ and $V_{2,max}$ disclosed above. Therefore any foamable liquid is useful in the present invention. It is preferred however that foamable liquids have a viscosity from about 1 cps to about 300 cps, more preferably from about 20 cps to about 130 cps, and most preferably from about 50 cps to about 100 cps.

The improved method comprises the steps of:

(a) mixing a quantity of said foamable liquid with a quantity of said gas to produce an intermediate foam at a volumetric flow rate Q; said intermediate foam comprises bubbles having a number-average diameter greater than about $D_1$ and a wider bubble size distribution than the final foam; and (b) passing said intermediate foam through at least one foam refining means which comprises a plurality of substantially uniformly-sized and evenly distributed passageways; wherein said intermediate foam passes through said passageways at a velocity, $V_2$, falling within the range of a minimum velocity, $V_{2,min}$, and a maximum velocity, $V_{2,max}$, wherein the conditions needed to cause bursting of said bubbles having a diameter larger than about $D_1$ are met.

The number-average bubble diameter, $D_1$, of the final foams dispensed by using the method of the present invention can range from about 0.05 mm to about 1 mm, more preferably from about 0.1 mm to about 0.6 mm, and most preferably from about 0.2 mm to about 0.4 mm.

FOAMABLE LIQUIDS

The foam dispenser of the present invention can be used to generate a stable homogeneous viscous foam from any conventional foamable liquid. Foamable liquids generally comprise a solvent and a surfactant (or surface-active agent). Solvent usually comprises about 50–99% of the liquid composition, and typically are water, lower alcohols, glycol ethers, and mixtures thereof. The surfactant component can comprise organic anionic, nonionic, amphoteric, and cationic, and mixtures thereof. Examples of such liquids are described in U.S. Pat. No. 3,709,437, issued on Jan. 9, 1973, which is hereby incorporated by reference. Additional foamable liquid compositions comprising a solvent and surfactant are disclosed in commonly-assigned and co-pending patent applications U.S. Ser. No. 989,746, filed on Dec. 10, 1992 and U.S. Ser. No. 797,519, filed on Nov. 22, 1991. A surfactant-free foamable liquid which can be used with the present invention is disclosed in commonly-assigned and co-pending patent application U.S. Ser. No. 025,907, filed on Mar. 3, 1993.

A typical composition for use as a facial cleanser which can be dispensed as a foam in a foam dispensing container of the present invention is shown in Tables A-1 and A-2. The improved foam dispenser and foam dispensing nozzle of the present invention can be used with a foamable liquid having a viscosity of from about 1 cps to about 300 cps, more preferably from about 20 cps to about 130 cps, most preferably from about 50 cps to about 100 cps at usage conditions. The viscosity of the above foamable liquids increases as the temperature of said liquids decreases. These viscosities are measured using standard measuring techniques known to those of ordinary skill as formulation chemists. The viscosity of the foamable liquid composition prior to it being made into a foam is determined using either a Brookfield Viscometer RVT (Brookfield Co., Stoughton, Mass.), Spindle 1 at 100 rpm (for viscosities up to 100 cps) and Spindle 2 at 100 rpm (for viscosities from 100 cps and above), or a Haake Rotoviscometer RV20 (Haake Corporation, Karlsruhe, Germany) with a cone-and-plate fixture (cone diameter of 41.74 mm, plate diameter of 45.00 mm, cone angle of $6.98\times10^{-2}$ rad and gap between the truncated apex of the cone and the plate of 0.175 mm). Although such foamable liquids are usually Newtonian fluids (i.e., the viscosity does not change with the applied shear rate), a foamable non-Newtonian fluid (e.g. shear-thinning liquid) can also be used. Foamable liquid composition products used in the present invention include, but are not limited to, hand soap, shampoo, body soap, hair mousse, shaving foam and kitchen cleanser.

The criteria used for comparing the quality of foams made from the foamable liquids used in the present invention are based on the following parameters:

1. Foam Density

The foam density for the resultant foams of the present invention is from about 0.01 g/cm$^3$ to about 0.25 g/cm$^3$, more preferably from about 0.05 g/cm$^3$ to about 0.15 g/cm$^3$, and most preferably from about 0.075 g/cm$^3$ to about 0.125 g/cm$^3$. The foam density is determined by weighing a given volume of foam immediately after dispensing. The ratio of the mass of the foamable liquid to the volume of air in such foam mixtures ranges from about 10 to about 300 g of liquid per liter of air, more preferably about 20 to about 130 g of liquid per liter of air, and most preferably about 30 to about 90 g of liquid per liter of air.

2. Apparent Foam Viscosity

The apparent foam viscosity at a shear rate of 10 reciprocal seconds (1/sec) for resultant foams immediately after dispensing is from about 500 cps to about 4,500 cps, more preferably is from about 1,000 cps to about 4,000 cps, and most preferably is from about 1,200 cps to about 3,000 cps. Apparent viscosity measurements of the foams are made using standard techniques and equipment, such as a Haake Rotoviscometer RV20 (Haake Corporation) using a cone-and-plate fixture (cone diameter of 41.74 mm, plate diameter of 45.00 mm, cone angle of $6.98\times10^{-2}$ rad and gap between the truncated apex of the cone and the plate of 0.175 mm). "Apparent viscosity" is used herein instead of just viscosity, since the viscosity value is calculated as the ratio of the stress to the applied shear rate, therefore, neglecting any effects of wall slip of the foam at the surfaces of the fixture.

3. Liquid Drainage

The liquid drainage from the foam is measured by introducing a certain amount of foam into a cubic fixture that is slightly tilted with respect to the perpendicular axis wherein the volume of liquid collected from the bottom of the cubic fixture over a specified amount of time is measured. Generally, well mixed foams containing more uniformly sized bubbles of smaller size produce less liquid drainage than poorly mixed foams containing less uniformly sized bubbles of larger size. In that respect, the liquid drainage test is considered a very informative measure of the quality of the foam.

The following are examples of foamable liquids useful in the present invention. In Tables A-1 and A-2 three dashed lines, i.e., "--- ", means that there is no such ingredient.

TABLE A-1

| Component | Weight % | | | |
|---|---|---|---|---|
| | I | II | III | IV |
| Water | QS100 | QS100 | QS100 | QS100 |
| Lauryldimonium Hydroxypropyl Hydrolyzed Collagen[1] | 7.14 | 7.14 | 7.14 | 7.14 |
| Hexylene Glycol | 6.50 | 8.50 | 9.00 | 7.77 |
| Decyl Polyglucoside[2] | 6.00 | 3.00 | 6.00 | 6.00 |
| Lauryl Polyglucoside[3] | 6.00 | 4.00 | 6.00 | 6.00 |
| LaurdimoniumHydroxypropyl Oxyethyl Cellulose[4] | 5.67 | 5.67 | 5.67 | 5.67 |
| Honey extract | 5.00 | 5.00 | 5.00 | 5.00 |
| Glycerin | 3.00 | 3.00 | 3.00 | 3.00 |
| Sodium Isostearoyl Lactylate | 1.00 | 1.00 | 1.00 | 1.00 |
| Glycerin (and) Water (and) Mixed Mucopolysaccharides (and) Glycogen[5] | — | 2.00 | — | — |
| Sorbitol (and) Sodium Lactate (and) Proline (and) Sodium PCA (and) Hydrolyzed Collagen[6] | — | 2.00 | — | — |
| 6-(N-acetylamino)-4-oxahexyl trimonium chloride[7] | — | 2.00 | — | — |
| Urea | — | 3.00 | 3.00 | 5.00 |
| Ammonium Cocoyl Isethionate[8] | — | — | 1.00 | 1.00 |
| Lauryl Pidolate | 2.25 | — | 1.00 | 2.00 |
| Perfume | 0.35 | 0.23 | 0.35 | 0.23 |
| DMDM Hydantoin Iodopropynyl Butylcarbamate | 0.10 | 0.10 | 0.10 | 0.10 |
| Ethylene diamine tetraacetate, Na | 0.10 | 0.10 | 0.10 | 0.10 |

TABLE A-2

| Component | Weight % | | |
|---|---|---|---|
| | V | VI | VII |
| Water | QS100 | QS100 | QS100 |
| Lauryldimonium Hydroxypropyl Hydrolyzed Collagen[1] | — | — | 3.50 |
| Hexylene Glycol | 2.77 | 2.00 | 7.77 |
| Decyl Polyglucoside[2] | 6.00 | 6.00 | 6.00 |
| Lauryl Polyglucoside[3] | 6.00 | 6.00 | 6.00 |
| LaurdimoniumHydroxypropyl Oxyethyl Cellulose[4] | 5.67 | — | 5.67 |
| Honey extract | 5.00 | 5.00 | 5.00 |
| Glycerin | 3.00 | 3.00 | 3.00 |
| Ammonium Cocoyl Isethionate[8] | 1.00 | — | 1.00 |
| Lauryl Pidolate | 2.00 | — | 2.00 |
| Protonated Polethylenimine[9] | — | 3.50 | — |
| Hydrolyzed Casein[10] | — | — | 3.00 |
| Perfume | 0.23 | 0.23 | 0.23 |
| DMDM Hydantoin Iodopropynyl Butylcarbamate | 0.10 | 0.10 | 0.10 |
| Ethylene diamine tetraacetate, Na | 0.10 | 0.10 | 0.10 |

TABLE A-2-continued

| Component | Weight % | | |
|---|---|---|---|
| | V | VI | VII |
| Triclosan | 0.25 | — | — |

[1]Available as an approximately 35% aqueous solution under the tradename Lamequat L from Henkel Corp.
[2]Available as an approximately 50% aqueous solution under the tradename APG 325 from Henkel Corp.
[3]Available as an approximately 50% aqueous solution under the tradename APG 625 from Henkel Corp.
[4]Available as an approximately 20% aqueous solution under the tradename Crodacel QL Special from Croda Corp.
[5]Available under the tradename Dermosaccharides HC from Laboratories Serobiologique.
[6]Available under the tradename Prodew 100 from Ajinomoto Corp.
[7]Available as an approximately 50% aqueous solution under the tradename Quamectant AM-50 from Brooks Industries.
[8]Available as an approximately 30% aqueous solution under the tradename Jordapon ACI-30 from PPG Mazer.
[9]Available as an approximately 50% aqueous solution under the tradename Polymin P from BASF.
[10]Available as an approximately 20–40% aqueous solution under the tradename Milk Q from Seiwa Kasei Co.

EXAMPLES

1) Invention Example - 1

A dual chamber pump foam dispenser manufactured by Daiwa Can as described in Japanese Laid-Open Utility Model No. Hei 3-7963 is mounted onto a suitable container, and is fitted with a foam dispensing nozzle of the present invention essentially as shown in FIG. 1. The Daiwa Can foam pump has a foam mixture discharge tube having a 0.6 cm inner diameter (area of 0.28 $cm^2$). The foam pump discharges a foam mixture of liquid and air having a volume of 20 $cm^3$ for each full stroke of the pump. The foam dispensing nozzle 1 of the present invention has an inlet opening of about 0.5 $cm^2$, a homogenizing screen 7 (100T mesh size, 0.183 mm opening size and 52% open area) having a total area of 0.16 $cm^2$ positioned in the inlet conduit 5, and a foam refining screen 30 (355T mesh size, 0.037 mm opening size and 26% open area) in the expanded conduit 10 having a total area of 1.0 $cm^2$. The foamable liquid Composition I of Table A-1, having a viscosity of about 80 cps (at 25° C.), is placed into the container and the pump and dispensing nozzle assembly is attached. When the pump is actuated at a rate of about 0.5–1.4 seconds per stroke, a thick, stable and homogeneous foam is made, having a negligible amount of larger bubbles, and is very uniform.

2) Invention Example - 2

A dual chamber pump foam dispenser manufactured by Daiwa Can as described in Japanese Laid-Open Utility Model No. Hei 3-7963 is mounted onto a suitable container, and is fitted with a foam dispensing nozzle of the present invention essentially as shown in FIG. 8. The Daiwa Can foam pump has a foam mixture discharge tube having a 0.6 cm inner diameter (area of 0.28 $cm^2$). The foam pump discharges a foam mixture of liquid and air having a volume of 20 $cm^3$ for each full stroke of the pump. The foam dispensing nozzle of the present invention has an inlet opening of about 0.5 $cm^2$, a homogenizing screen 7 (100T mesh size, 0.183 mm opening size and 52% open area) having a total area of 0.16 $cm^2$ positioned in the inlet conduit 5, a static mixer 39 of Kenics type with 3 helical elements of alternating left- and right-hand pitch located in the connecting conduit 10, wherein the diameter of the static mixer is 1.27 cm (0.5 in.), and a foam refining screen 30 (183 by 264 dual-mesh size, 0.053 mm opening size and 21% open area) at the discharge end 19 of the connecting conduit 10 having a total area of 1.27 $cm^2$. The foamable liquid Composition I of Table A-1, having a viscosity of about 80 cps (at 25° C.), is placed into the container and the pump and dispensing nozzle assembly is attached. When the pump is actuated at a rate of about 0.45–2 seconds per stroke, a thick, stable and homogeneous foam is made, having a negligible amount of larger bubbles, and is very uniform. Furthermore, when the pump is actuated at a rate of about 0.45–2 seconds per stroke, the dispensed foam exhibits liquid drainage characteristics which are independent of the actuation dynamics.

3. Invention Example - 3

A dual chamber pump foam dispenser manufactured by Daiwa Can as described in Japanese Laid-Open Utility Model No. Hei 3-7963 is mounted onto a suitable container, and is fitted with a foam dispensing nozzle of the present invention essentially as shown in FIG. 7. The Daiwa Can foam pump has a foam mixture discharge tube having a 0.6 cm inner diameter (area of 0.28 $cm^2$). The foam pump discharges a foam mixture of liquid and air having a volume of 20 $cm^3$ for each full stroke of the pump. The foam dispensing nozzle of the present invention has an inlet opening of about 0.5 $cm^2$, a homogenizing screen 7 (100T mesh size, 0.183 mm opening size and 52% open area) having a total area of 0.16 $cm^2$ positioned in the inlet conduit 5; an intermediate foam refining screen 38 (183 by 264 dual-mesh size, 0.053 mm opening size and 21% open area) having a total area of 1.0 $cm^2$; and a discharge foam refining screen 30 (355T mesh size, 0.037 mm opening size and 26% open area) in the expanded conduit 10 having a total area of 1.0 $cm^2$. A foamable liquid having a viscosity of about 20 cps (at 25° C.), is placed into the container and the pump and dispensing nozzle assembly is attached. When the pump is actuated at a rate of about 0.3–2.4 seconds per stroke, a thick, stable and homogeneous foam is made, having a negligible amount of larger bubbles. The persistence of the said foam is about 20% to 30% higher than that of a foam dispensed from a nozzle without the said intermediate screen. If the intermediate foam refining screen is replaced by a 305 mesh screen (0.053 mm opening size and 41% open area) the foam quality is comparable to the foam quality of a foam dispensed from the same nozzle but without the intermediate screen.

4) Prior Art Example

In comparison, the same dual chamber foam pump of Invention Examples 1 to 3 is fitted with a conventional foam dispensing nozzle which has an inlet opening of about 0.5 $cm^2$, a homogenizing screen 7 (100T mesh size, 0.183 mm opening size, and 52% open area) having a total area of 0.16 $cm^2$ positioned in the inlet opening 5, and a 0.34 $cm^2$, substantially-rectangular and constant cross-sectional area discharge conduit that has a second foam refining screen therein. The screen is a 20OS mesh screen (0.082 mm opening size and 42% open area) having a total area of 0.25 $cm^2$. The pump is actuated in the same manner described above in the invention example. The foam generated has a significant amount of larger bubbles and is non-uniform and runny, and the operation of the pump requires more actuation pressure than the invention examples.

What is claimed is:

1. A foam dispensing nozzle for dispensing a final foam from an incoming intermediate foam, said nozzle comprising:

(a) an inlet conduit for receiving the incoming intermediate foam from an initial foam refining means, the incoming intermediate foam consisting of a foamed mixture of a foamable liquid and a gas at an intermediate foam velocity;

(b) a final foam refining means for converting the intermediate foam into a final foam located in fluid communication with the inlet conduit and having a plurality of substantially uniformly-sized and evenly distributed passageways therethrough, the passageways having a dimension from about 0.020 mm to about 0.120 mm; and (c) a velocity decreasing means for reducing the intermediate foam velocity to a velocity no greater than 300 cm/sec through the foam refining means, the velocity decreasing means being located between and in fluid communication with the inlet conduit and the foam refining means.

2. A foam dispensing nozzle according to claim 1 wherein said velocity decreasing means comprises a volume expanding means.

3. A foam dispensing nozzle according to claim 2 wherein the volume expanding means is an expanded conduit having a cross-sectional area at its outlet at least larger than across sectional area of its inlet.

4. A foam dispensing nozzle according to claim 3 wherein said ratio of cross-sectional areas of the outlet to inlet is from about 2:1 to about 8:1.

5. A foam dispensing nozzle according to claim 4 wherein said expanded conduit has a rectangular cross sectional shape having a height to width ratio from about 1:1.5 to about 1:2.

6. A pump foam dispenser for dispensing a final foam from an incoming intermediate foam, said dispenser comprising a reservoir to contain said foamable liquid, a manually-actuable means for generating a volume of a mixture of said foamable liquid and a gas, and a foam dispensing nozzle sealably attached in fluid communication with said manually-actuable means wherein the improvement comprises a nozzle comprising:

(a) an inlet conduit for receiving the incoming intermediate foam from an initial foam refining means, the incoming intermediate foam consisting of a foamed mixture of a foamable liquid and a gas at an intermediate foam velocity;

(b) a final foam refining means for converting the incoming intermediate foam into a final foam located in fluid communication with the inlet conduit and having a plurality of passageways therethrough, the passageways having a dimension from about 0.020 mm to about 0.120 mm; and (c) a velocity decreasing means for reducing the intermediate foam velocity to a velocity no greater than 300 cm/sec through the passageways of the foam refining means, the velocity decreasing means being located between and in fluid communication with the inlet conduit and the foam refining means.

7. A foam dispensing nozzle according to claim 1 or 6 wherein the total area of the final foam refining means is from about 0.5 $cm^2$ to about 10 $cm^2$ and the percentage open area is from about 15% to about 50%.

8. A foam dispensing nozzle according to claim 2 or 6 wherein said passageways of said screen have a dimension from about 0.035 mm to about 0.080 mm.

9. A foam dispensing nozzle according to claim 1 or 6 wherein the total area of the final foam refining means is from about 1 $cm^2$ to about 2 $cm^2$ and the percentage open area is from about 20% to about 40%.

10. The manually-actuable foam dispenser according to claim 4 or 6 wherein said foam dispenser is a pump foam dispenser.

* * * * *